US008434757B2

(12) United States Patent
Miwa

(10) Patent No.: US 8,434,757 B2
(45) Date of Patent: May 7, 2013

(54) SHEET FEEDER AND IMAGE FORMING APPARATUS

(75) Inventor: Atsushi Miwa, Anjo (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/406,874

(22) Filed: Feb. 28, 2012

(65) Prior Publication Data

US 2012/0217700 A1 Aug. 30, 2012

(30) Foreign Application Priority Data

Feb. 28, 2011 (JP) ..... 2011-041579

(51) Int. Cl.
*B65H 3/34* (2006.01)
*B65H 3/52* (2006.01)

(52) U.S. Cl.
USPC ..... 271/167; 271/124; 271/122

(58) Field of Classification Search ..... 271/121, 271/122, 124, 243–246, 167, 262
See application file for complete search history.

(56) References Cited

U.S. PATENT DOCUMENTS 6,431,541 B2 * 8/2002 Kuo et al. ..... 271/118
7,255,339 B2 * 8/2007 Hung et al. ..... 271/122
7,566,052 B2 * 7/2009 Hsu et al. ..... 271/121
8,047,533 B2 * 11/2011 Kuo ..... 271/121
8,118,304 B1 * 2/2012 Chen et al. ..... 271/256
8,292,289 B2 * 10/2012 Kotaka et al. ..... 271/117
2004/0188918 A1 * 9/2004 Morimoto et al. ..... 271/121
2012/0261878 A1 * 10/2012 Lai ..... 271/227

FOREIGN PATENT DOCUMENTS

JP 04-086632 7/1992

* cited by examiner

*Primary Examiner* — Patrick Cicchino
(74) *Attorney, Agent, or Firm* — Banner & Witcoff, Ltd.

(57) ABSTRACT

A sheet feeder includes a loading surface, a supply roller configured to feed recording sheets loaded on the loading surface, an overload prevention member disposed upstream from the supply roller in a sheet feed direction, and a movable member disposed downstream from the overload prevention member in the sheet feed direction. The overload prevention member includes a restriction surface configured to be moved between a first position and a second position. The movable member is configured to be moved from a third position to a fourth position by being pushed by leading ends of the recording sheets. The movable member and the overload prevention member are configured to interlock each other such that, when the movable member is in the third position, the restriction surface is in the first position, and when the movable member is in the fourth position, the restriction surface is in the second position.

15 Claims, 7 Drawing Sheets

SHEET FEEDER AND IMAGE FORMING APPARATUS

CROSS REFERENCE TO RELATED APPLICATION

This application claims priority from Japanese Patent Application No. 2011-041579, filed on Feb. 28, 2011, the content of which is incorporated herein by reference in its entirety.

TECHNICAL FIELD

Aspects of the disclosure relate to a sheet feeder configured to feed a recording sheet and an image forming apparatus including the sheet feeder.

BACKGROUND

To prevent overloading of recording sheets, a known sheet feeder may include an overload prevention plate for limiting the number of recording sheets to be loaded. The overload prevention plate is disposed at a distance from a surface on which a sheet is loaded. In this art, if the overload prevention plate contacts a stack of sheets, the sheets may be fed under load. Thus, the overload prevention plate is separated from a stack of sheets by a solenoid while the sheets are fed.

However, in the above art, the solenoid is exclusively used to separate the overload prevention plate from the sheets, and thus it increases the cost of manufacturing.

SUMMARY

Aspects of the disclosure may provide a structure to withdraw an overload prevention member from a stack of sheets without a dedicated drive source, for cost reduction.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A general structure of an image forming apparatus, e.g., a color printer 1, will be described.

Figure 1:
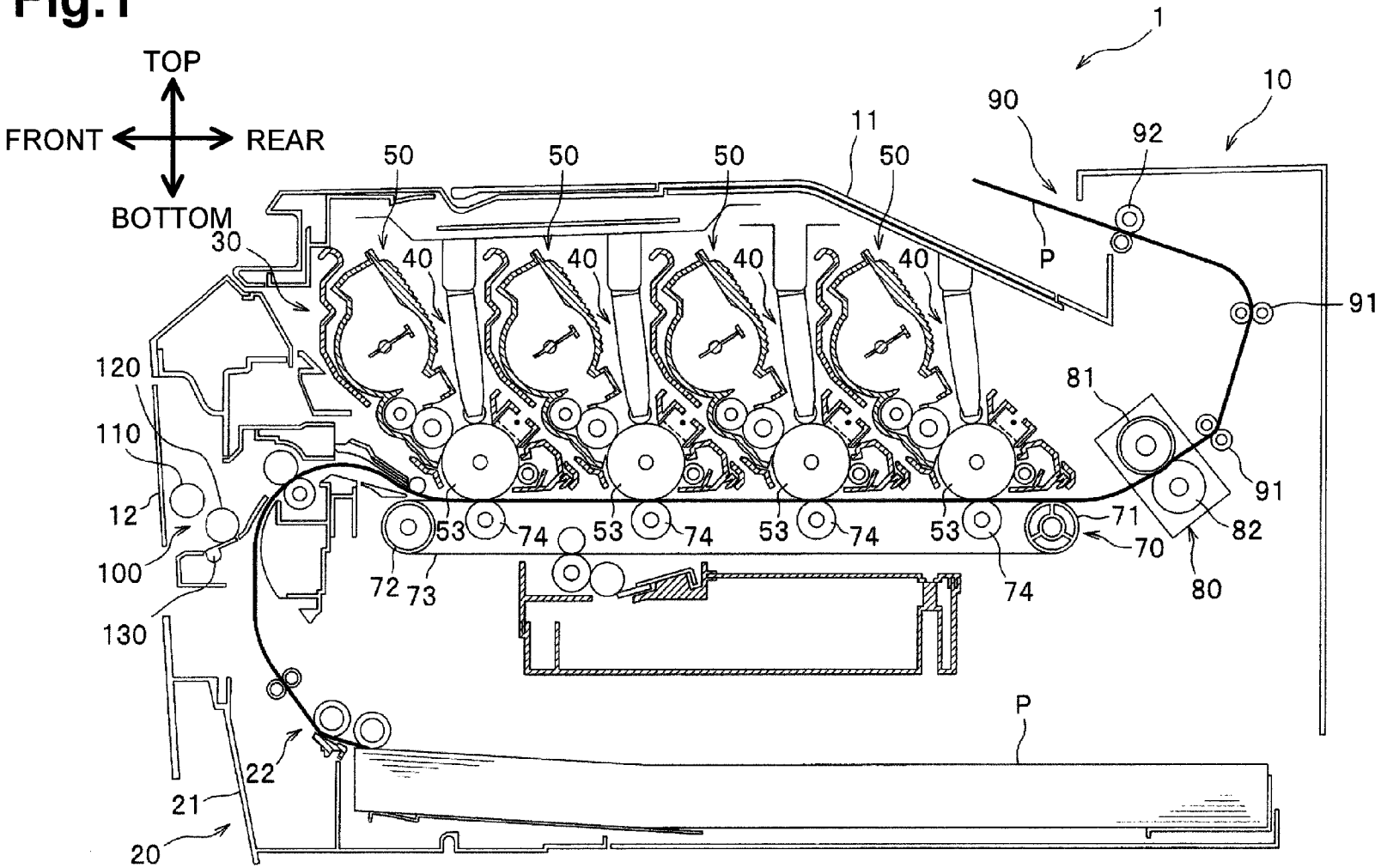
FIG. 1 is a sectional view schematically illustrating a color printer according to an illustrative embodiment.

In the following description, directions are referred when the color printer 1 is viewed from a user in front of the color printer 1. In FIG. 1, the left side of the drawing is referred to as the front or front side of the color printer 1, and the right side of the drawing is referred to as the rear or rear side of the color printer 1. When the color printer 1 is viewed from the front side, the left side is referred to as the left or left side, and the right side is referred to as the right or right side. The directions, front, rear, left, right, top, and bottom, shown in each drawing are referenced based on the directions shown in FIG. 1.

As shown in FIG. 1, the color printer 1 may include, in a main body 10, a sheet supply unit 20, an image forming unit 30, and an ejection portion 90. The sheet supply unit 20 is configured to supply a recording medium, e.g., a sheet P. The sheet P may include a plain sheet, thick sheet, a thin sheet, and a transparent sheet. The image forming unit 30 is configured to form an image on a sheet P supplied from the sheet supply unit 20. The ejection portion 4 is configured to eject a sheet P having an image formed thereon.

The sheet supply unit 20 may be disposed in a lower portion of the main body 10, and may include a sheet supply tray 21 and a sheet supply mechanism 22. The sheet supply tray 21 is configured to store a stack of sheets P. The sheet supply tray 21 may be non-destructively attachable to and removable from the main body 10. The sheet supply mechanism 22 is configured to feed a sheet P from the sheet supply tray 21 to the image forming unit 30. In the sheet supply unit 20, sheets P in the sheet supply tray 21 are singly separated by the sheet supply mechanism and then fed to the image forming unit 30.

The image forming unit 30 may include a plurality of, e.g., four, LED units 40 and four process cartridges 50, a transfer unit 70, and a fixing unit 80.

Each LED unit 40 may include a plurality of LEDs to expose the photosensitive drum 53.

Each process cartridge 50 may mainly include a photosensitive drum 53, a charger, and a developing roller and a toner chamber, which are known and shown without numerals.

The transfer unit 70 may be disposed between the sheet supply unit 20 and the process cartridges 50, and may include a drive roller 71, a driven roller 72, a belt 73, and a plurality of, e.g., four, transfer rollers 74.

The fixing unit 80 may include a heat roller 81 and a pressure roller 82 disposed facing the heat roller 81 and configured to press the heat roller 81.

In the image forming unit 30, the surfaces of the rotating photosensitive drums 53 are uniformly charged by the respective chargers, and exposed by the respective LED units 40. As a result, a potential in an exposed area is lowered, and thus electrostatic latent images based on image data are formed on the respective surfaces of the photosensitive drums 53. Then, toner is supplied to the electrostatic latent images by the respective developing rollers, so that toner images are carried on the respective surfaces of the photosensitive drums 53.

Then, a sheet P supplied to the belt 73 passes between the photosensitive drums 53 and the belt 73 above the transfer rollers 74, and the toner images carried on the surfaces of the photosensitive drums 53 are sequentially transferred and overlaid one on top of the other on the sheet P. When the sheet P having the toner images passes between the heat roller 81 and the pressure roller 82, the toner images are fixed onto the sheet P by heat.

The ejection portion 90 may include a plurality of pairs of feed rollers 91 and a pair of ejection rollers 92. In the ejection portion 90, the sheet P ejected from the fixing unit 80 is fed by the plurality of pairs of feed rollers 91 and ejected to an output tray 11 by the pair of ejection rollers 92.

A manual feed mechanism 100, as an example of a sheet feeder, is disposed in a front side of the main body 10. The manual feed mechanism 100 may include a manual feed tray 12, a supply roller 110, a separation roller 120 and a separation pad 130. The manual feed tray 12 is configured to pivot between an open position and a closed position relative to the main body 10. The supply roller 110 is configured to feed sheets P placed on the manual feed tray 12 in the open position toward the inside of the main body 10. The separation roller 120 and the separation pad 130 are configured to separate a single sheet P from the sheets P fed by the supply roller 110.

Figure 2:
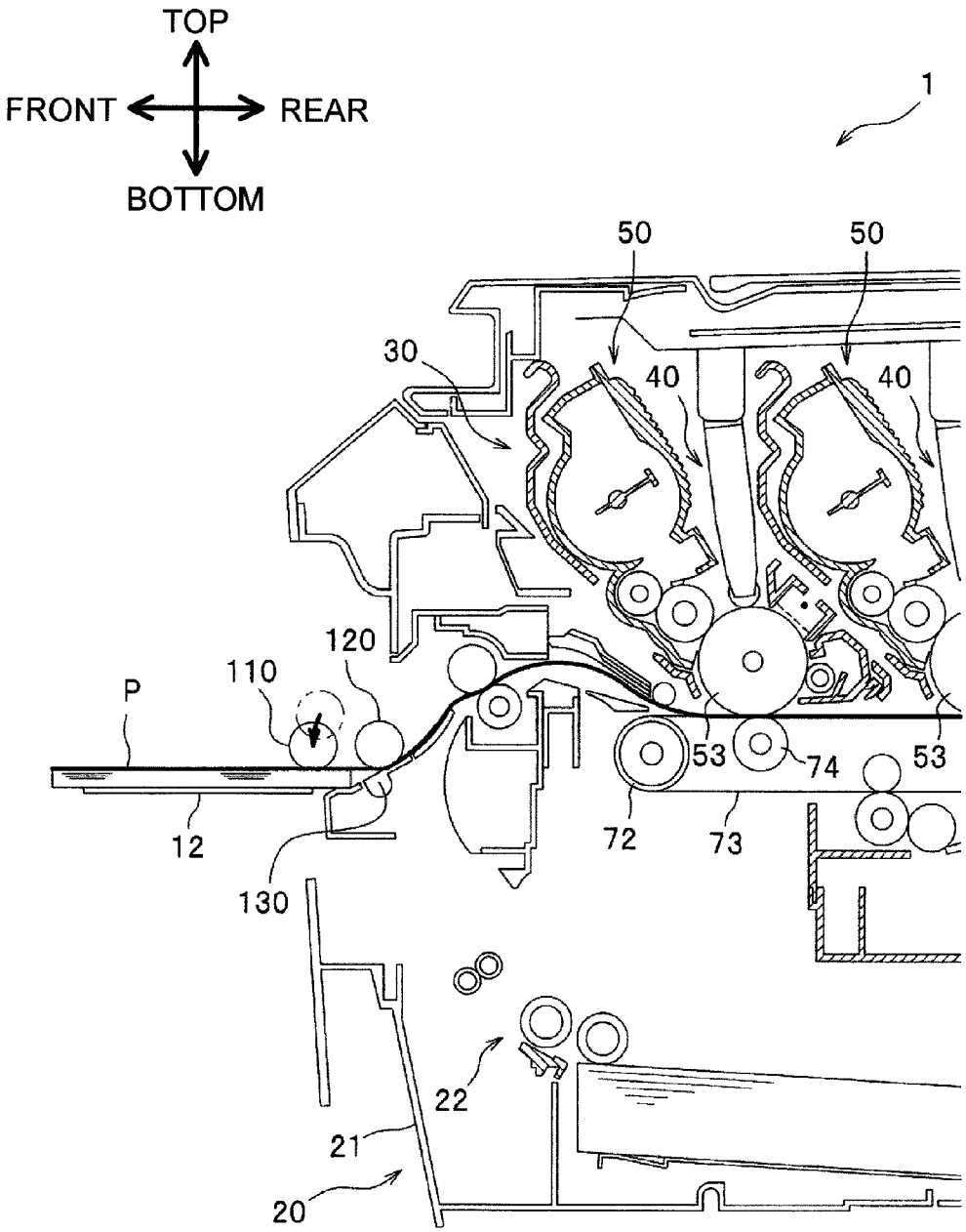
FIG. 2 is a sectional view schematically illustrating a manual feed tray being open.

In the manual feed mechanism 100, when an instruction to print a sheet P placed on the manual feed tray 12 is inputted with a stack of sheets P being loaded on the manual feed tray 12 tilted substantially horizontally in the open position, the supply roller 110 moves downward and contacts the uppermost sheet P as shown in FIG. 2. As the supply roller 110 contacting the sheet P rotates, the sheet P is supplied to the image forming unit 30 in the main body 10 via the separation roller 120 and so on.

After the sheet P is supplied, the supply roller 110 is returned to an upper standby position and held at the standby position until a subsequent instruction is inputted. In the following description, an operation of the supply roller 110 to feed a sheet P is also referred to as a pickup operation.

A structure of the manual feed mechanism 100 will be described in detail.

Figure 3:
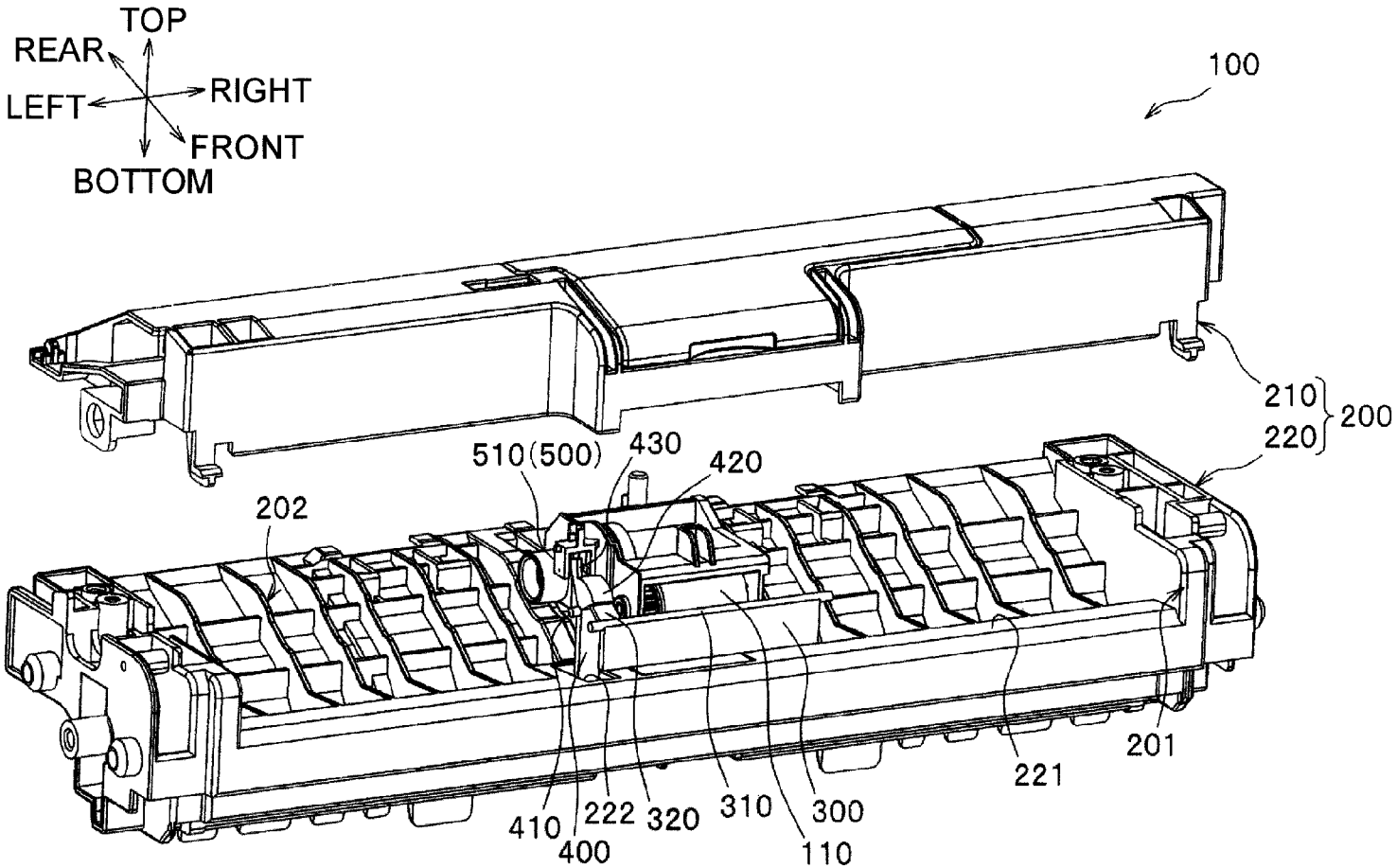
FIG. 3 is an exploded perspective view of a manual feed mechanism.

As shown in FIG. 3, the manual feed mechanism 100 may include a casing 200, the supply roller 110, a blocking member, e.g. an overload prevention member 300, and an actuator, e.g. a movable member 400.

The casing 200 includes an upper frame 210 and a lower frame 220, which form therebetween a slot 201 for inserting a sheet P into the casing 200, and a feed path 202 along which the sheet P is fed toward the image forming unit 30. The slot 201 is defined by a loading surface 221 on which a stack of sheets P are loaded. The loading surface 221 is flush with an upper surface of the opened manual feed tray 12 and is used to support a sheet P along with the upper surface of the manual feed tray 12.

Figure 4:
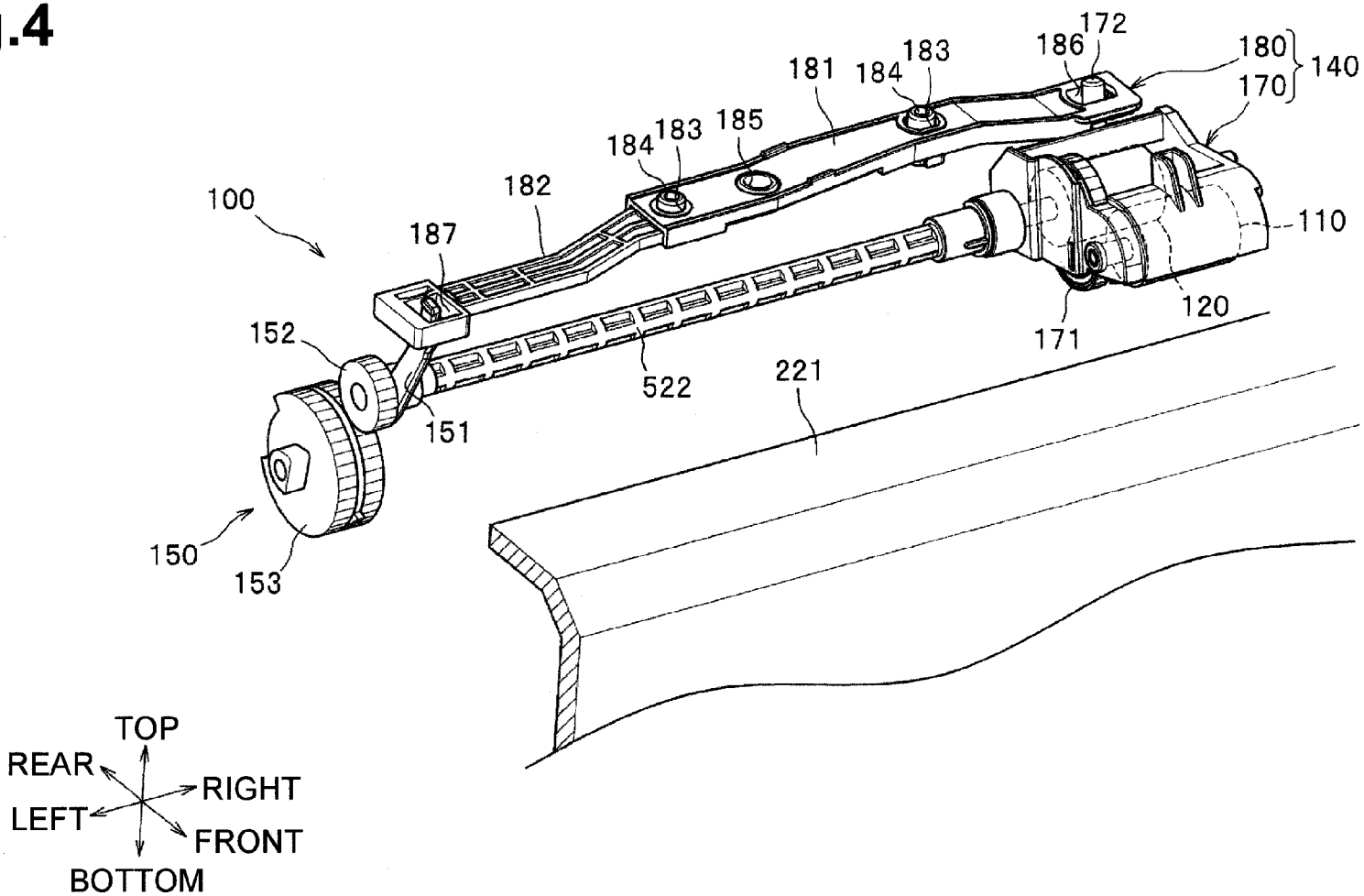
FIG. 4 is a perspective view illustrating a support mechanism and a drive mechanism.

The supply roller 110 is configured to feed a sheet P loaded on the manual feed tray 12 and the loading surface 221 and be moved vertically by a support mechanism 140 and a drive mechanism 150 which are shown in FIG. 4.

The support mechanism 140 is configured to support the supply roller 110 such that the supply roller 110 is movable vertically. The support mechanism 140 mainly includes a support member 170 and a swing arm 180. The support member 170 is configured to support the supply roller 110 and the separation roller 120 rotatably. The swing arm 180 is long and configured such that one end, e.g., a right end, of the swing arm 180 engages with the support member 170.

The support member 170 is formed in the shape of an open bottom container in which the supply roller 110 and the separation roller 120 are rotatably disposed and a gear 171 is disposed for transmitting a drive force from the separation roller 120 to the supply roller 110. The support member 170 is supported by the upper frame 210 of the casing 200 such that the support member 170 is vertically pivotable about the separation roller 120. The support member 170 includes an engaging projection 172 configured to engage the right end side of the swing arm 180.

The swing arm 180 includes a first arm 181 and a second arm 182, which are assembled. Specifically, a pair of projecting portions 184 formed on a right side of the second arm 182 are fitted into a pair of holes 183 formed on a left side of the first arm 181, thereby forming the long swing arm 180.

The swing arm 180 includes a through hole 185, which is formed through the first arm 181 and the second arm 182, in a central portion of the swing arm 180 or between the pair of projecting portions 184. A boss (not shown) provided in the upper frame 210 of the casing 200 is engaged in the through hole 185, such that the swing arm 180 is configured to swing back and forth in a horizontal plane.

The swing arm 180 has an engaging hole 186, which is formed on a right end of the first arm 181 and engages the engaging projection 172 of the support member 170. With this engagement, when the right end of the swing arm 180 swings rearward, the engaging projection 172 is pressed rearward at a rim around the engaging hole 186, the support member 170 pivots about the separation roller 120 upward, and the supply roller 110 pivots upward.

Conversely, when the right end of the swing arm 180 swings frontward, the engaging portion 172 is pressed frontward at the rim around the engaging hole 186, the support member 170 pivots about the separation roller 120 downward, and the supply roller 110 moves downward. The swing arm 180 has a hole 187, which is formed on a left end of the second arm 182 and engages a stopper member 151 of the drive mechanism 150.

Figure 5A:
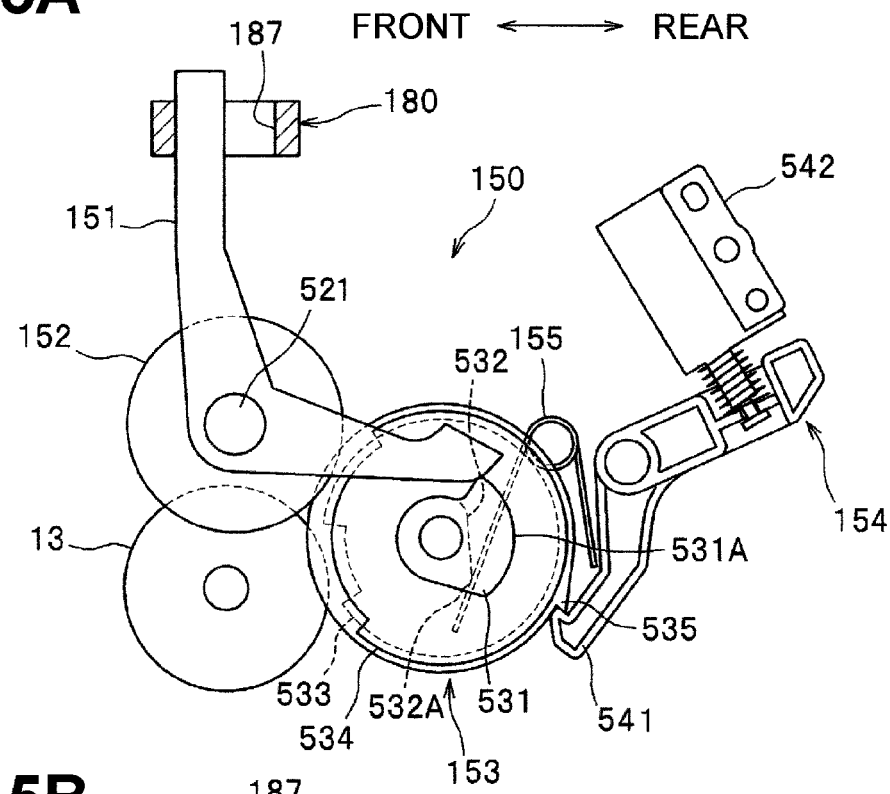
FIG. 5A illustrates the drive mechanism in normal operation.
Figure 5B:
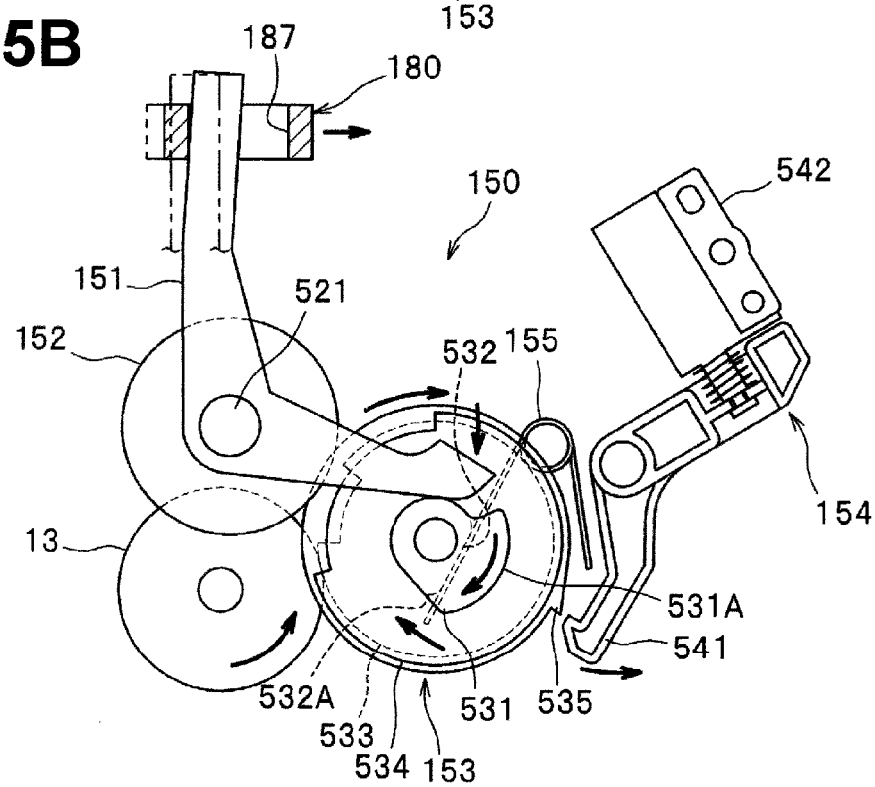
FIG. 5B illustrates the drive mechanism when a latch mechanism is disengaged.

The drive mechanism 150 is configured to act on the support mechanism 140 and move the supply roller 110 downward from the upper standby position to bring the supply roller 110 to contact a sheet P on the loading surface 221 when the sheet P is fed toward the inside of the main body 10 (or when an instruction for manual feed printing is inputted). Specifically, as shown in FIG. 5A, the drive mechanism 150 includes the stopper member 151, a separation roller driving gear 152, a two-tier missing teeth gear 153, a latch mechanism 154, and a torsion spring 155. In FIGS. 5A to 5C, each gear is drawn as a pitch circle for the sake of convenience.

The stopper member 151 is shaped in the form of a letter L, extending in two directions, upward and rearward. The stopper member 151 is rotatably supported at its bending portion by a shaft 521 of the separation roller driving gear 152. Under normal conditions or when no instruction for manual feed printing is inputted, an upper end of the stopper member 151 engages a front rim around the hole 187 of the swing arm 180 and a lower end of the stopper member 151 contacts a bulging portion 531A of a support cam 531 of the two-tier missing teeth gear 153. With this configuration, under normal conditions, the stopper member 151 restricts the rearward movement of the left end of the swing arm 180 by weight of the supply roller 110.

As shown in FIG. 5B, when the support cam 531 rotates from its initial position and then the bulging portion 531A of the support cam 531 is disengaged from the stopper member 151, the restriction by the stopper member 151 is released, and the left end portion of the swing arm 180 moves rearward while causing the stopper member 151 to pivot.

As shown in FIG. 4, the separation roller driving gear 152 is fixed to a connection shaft 522 coaxially with the separation roller 120 such as to rotate along with the separation roller 120.

As shown in FIG. 5A, the two-tier missing teeth gear 153 includes the support cam 531, a start cam 532, an input-side missing teeth gear section 533, an output-side missing teeth gear section 534, and an engaging pawl 535. In FIG. 5A, pitch circles corresponding to the input-side missing teeth gear section 533 and the output-side missing teeth gear section 534 are drawn with different diameters for the sake of convenience.

The start cam 532 is disposed on an end face of the two-tier missing teeth gear 153 facing leftward and outward in a left-right direction (or an opposite end face to the support cam 531). Under normal conditions shown in FIG. 5A, the start cam 532 is maintained such that an end portion 532A of the start cam 532 presses and shrinks the torsion spring 155. The input-side missing teeth gear portion 533 has a gear section and a missing teeth section in its entire perimeter. Under normal conditions, the missing teeth section faces the input gear 13. The input gear 13 is configured to receive a drive force transmitted from a motor (a drive source) disposed in the main body 10.

The output-side missing teeth gear portion 534 has a gear section and a missing teeth section in its entire perimeter. Under normal conditions, the missing teeth section faces the separation roller driving gear 152. The engaging pawl 535 is formed so as to protrude outward in a radial direction from an outer surface between the input-side missing teeth gear portion 533 and the output-side missing teeth gear portion 534. Under normal conditions, the engaging pawl 535 engages a latch arm 541 of the latch mechanism 154.

The latch mechanism 154 includes the latch arm 541, which is pivotable, and a solenoid 542 that presses and pulls a base end portion of the latch arm 541.

The drive mechanism 150 structured as described above causes the stopper member 151, the two-tier missing teeth gear portion 153 and the latch mechanism 154 to restrict the rearward movement of the left end portion of the swing arm 180 under normal conditions as shown in FIG. 5A. As shown in FIG. 5B, when the latch arm 541 is disengaged from the engaging pawl 535 of the two-tier missing teeth gear portion 153 by actuating the solenoid 542 from the normal condition state, the start cam 532 is pressed by a predetermined amount clockwise by an urging force of the torsion spring 155, and the two-tire missing teeth gear portion 153 rotates by a predetermined amount.

With this movement, the bulging portion 531A of the support cam 531 that rotates along with the two-tier missing teeth gear portion 153 is disengaged from the stopper member 151, the stopper member 151 pivots and the left end portion of the swing arm 180 moves rearward. At this time, the input-side missing teeth gear portion 533 rotates along with the two-tier missing teeth gear 153, and the gear section of the input-side missing teeth gear portion 533 engages the input gear 13.

Then, along with the input gear 13 that rotates by the motor, the two-tier missing teeth gear 153 starts to rotate. After a specified time elapsed since the two-tire missing teeth gear 153 starts to rotate by the drive force of the input gear 13, the gear section of the output-side missing teeth gear portion 534 engages the separation roller driving gear 152, and the drive force from the motor in the main body 10 is transmitted to the separation roller 120 and the supply roller 110.

For a period of time from when the input gear 13 and the missing teeth section of the input-side missing teeth gear portion 533 face each other to when transmission of the drive force from the input gear 13 is terminated, the bulging portion 531A of the support cam 531 lifts the rear end of the stopper member 151 to its initial position, and the start cam 532 presses the torsion spring 155 into its original shrunk state. The engaging pawl 535 engages the latch arm 541 again. In this manner, the drive mechanism 150 returns to its initial position.

Figure 6:
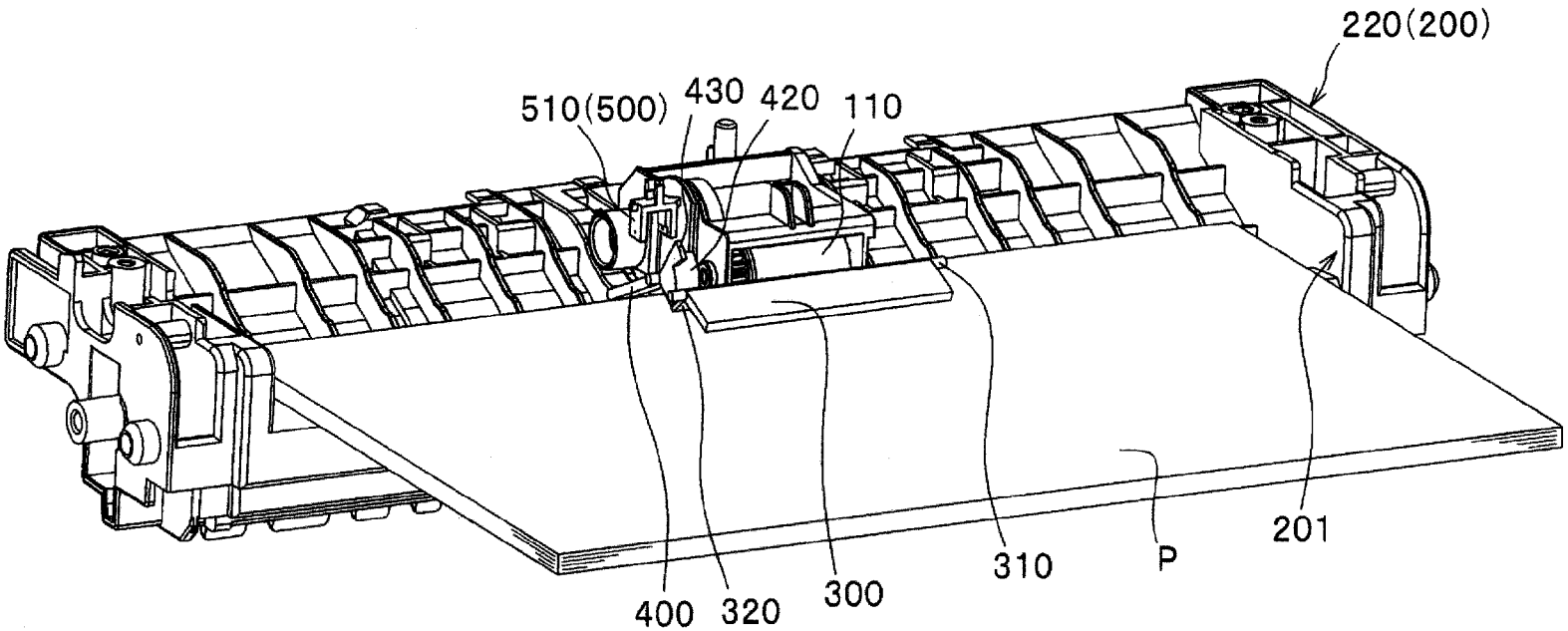
FIG. 6 is a perspective view illustrating that a recording sheet is inserted into an opening of the manual feed mechanism from which an upper frame is removed.

As shown in FIGS. 3 and 6, the overload prevention member 300 is configured to rotate together with the movable member 400, which is pressed by ends of sheets P inserted into the slot 201 and then rotates, such that the overload prevention member 300 withdraws from the sheets P. Thus, the overload prevention member 300 does not interfere with sheet supply by the supply roller 110.

Figure 7A:
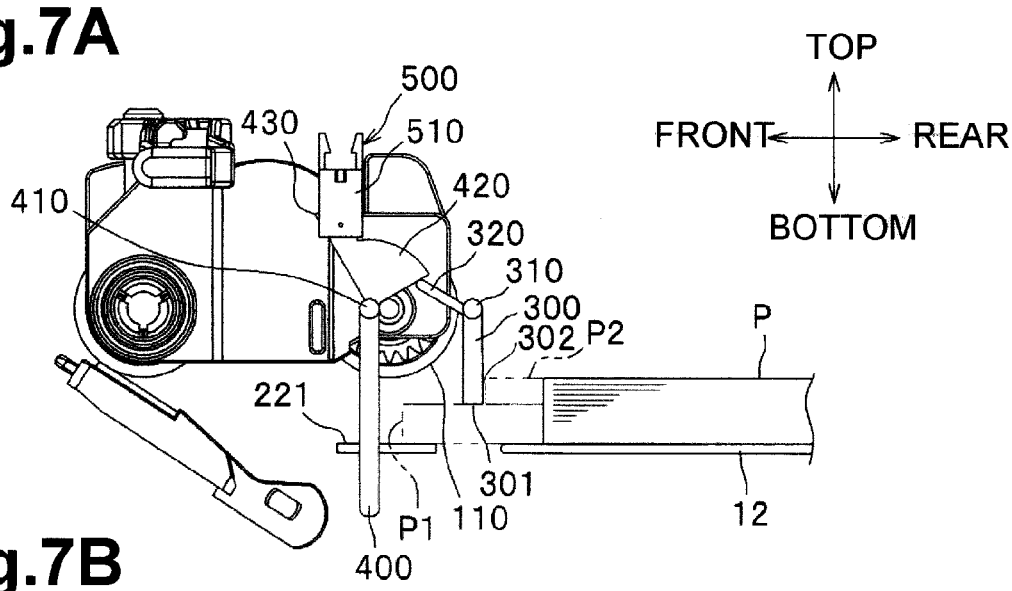
FIG. 7A illustrates that an overload prevention member is located in a first position.

Specifically, the overload prevention member 300 is shaped in a plate-like member elongated in the left-right direction (a width direction of the sheet P). As shown in FIG. 7A, the overload prevention member 300 is disposed in front of the supply roller 110 (or upstream from the supply roller 110 in a sheet feed direction). The overload prevention member 300 is rotatably disposed in the upper frame 210 of the casing 200. In FIGS. 6 and 7, the upper frame 210 is omitted for the sake of convenience, and the overload prevention member 300 and its peripheral elements are illustrated as if they are floating in the air. The overload prevention member 300 includes a restriction surface 301 and a block surface 302. In a case where no sheets P are loaded on the loading surface 221, the overload prevention member 300 is oriented such that a block surface 302 is normal to the sheet feed direction and the restriction surface 301 faces downward (toward the loading surface 221). In this orientation, the restriction surface 301 restricts the number of sheets P that can be loaded or defines a distance from the loading surface 221.

The restriction surface 301 is disposed below a lower end portion of the supply roller 110 located in the standby position. Thus, a clearance is provided between the supply roller 110 and an uppermost sheet P in a stack P1 having a maximum number of sheets P limited by the restriction surface 301. Thus, the pickup operation can be reliably performed.

A rotational shaft 310 is disposed at an upper end of the overload prevention member 300 and rotatably supported by the upper frame 210 of the casing 200. Thus, the overload prevention member 300 is movable about the rotational shaft 310 such that the restriction surface 301, which is disposed at a lower end of the overload prevention member 300, faces diagonally upward and frontward (toward the upstream side in the sheet feed direction). Specifically, the restriction surface 301 can be moved between a first position shown in FIG. 7A and a second position shown in FIG. 7B. In the first position, the restriction surface 301 is vertically separated a predetermined distance away from the loading surface 221 to limit the number of sheets P to be loaded on the loading surface 221. In the second position, the restriction surface 301 is separated away from the loading surface 221 diagonally upward and frontward further than in the first position. In other words, the block surface 302 can be moved between the first position shown in FIG. 7A and the second position shown in FIG. 7B.

The rotational shaft 310 includes an engaging piece 320 positioned on a left end portion of the rotational shaft 310. The engaging piece 320 extends diagonally upward and rearward (outward in a radial direction of the rotational shaft 310 and in a direction different from the overload prevention member 300). The movable member 400 engages the engaging piece 320. Thus, the overload prevention member 300 rotates along with the movement of the movable member 400.

As shown in FIG. 6, the overload prevention member 300 is of a length shorter than the width of a sheet P (having a maximum size printable in the color printer 1). Thus, compared with a case where the overload prevention member is formed extending across the entire width of the sheet P, the weight of the overload prevention member 300 can be reduced, which allows the overload prevention member 300 to rotate smoothly.

The overload prevention member 300 is disposed in a position corresponding to the center of the width of the sheet P to be loaded on the loading surface 221. Thus, the overload prevention member 300 can reduce the overload of the sheets P even if the sheets P are small-sized, in a structure where sheets P of any size are centered and fed.

The overload prevention member 300 is urged by an urging member, e.g., a torsion spring, not shown, such that the restriction surface 301 is located in the first position. Without the urging member, the overload prevention member 300 may be urged by its own weight such that the restriction surface 301 returns to the first position from the second position.

As shown in FIG. 7A, the movable member 400 is shaped in a plate-like member extending vertically, and disposed downstream from the overload prevention member 300 in the sheet feed direction (specifically in a position where the movable member 400 overlaps the supply roller 110 when viewed from an axial direction of the supply roller 110). The movable member 400 is formed such that its upper end extends upward more than the restriction surface 301 of the overload prevention member 300 and its lower end extends downward more than the loading surface 221. As shown in FIG. 3, an opening 222 is formed near a center of the loading surface 221 of the lower frame 220 in the width direction. The lower end of the movable member 400 is disposed below the loading surface 221 in the opening 222.

Figure 7B:
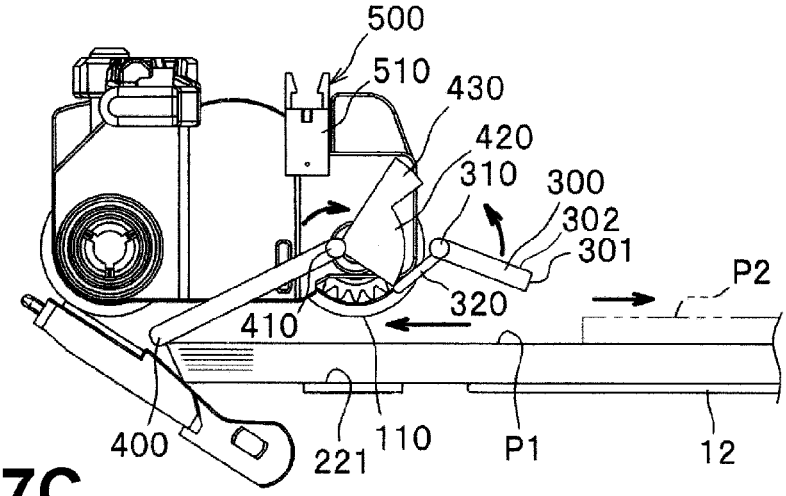
FIG. 7B illustrates that the overload prevention member is located in a second position.

A rotational shaft 410 is disposed in the upper end of the movable member 400 and rotatably supported by the upper frame 210 of the casing 200. In FIGS. 6 and 7, the lower frame 220 is omitted for the sake of convenience, and the movable member 400 and its peripheral elements are drawn as if they are floating. When the sheets P are inserted downstream further than the restriction surface 301 of the overload prevention member 300 in the sheet feed direction, the leading ends of the sheets P contact the movable member 400, and the movable member 400 is pushed by the leading ends of the sheets P, so that the movable member 400 is moved, e.g., rotated, from a third position shown in FIG. 7A to a fourth position shown in FIG. 7B.

The rotational shaft 410 includes an operating portion 420 having a sector shape extending upward (outward in a radial direction of the rotational shaft 410 and in a direction different from the movable member 400). A front surface of the operating portion 420 engages the engaging piece 320 of the overload prevention member 300. When the movable member 400 rotates from the third position to the fourth position, the operating portion 420 presses the engaging piece 320 downward, such that the overload prevention member 300 rotates counterclockwise.

In other words, the movable member 400 and the overload prevention member 300 are configured to interlock such that, when the movable member 400 is located in the third position, the restriction surface 301 of the overload prevention member 300 is located in the first position, and when the movable member 400 is located in the fourth position, the restriction surface 301 is located in the second position. A detector, e.g., an optical sensor 500, is disposed above the operating portion 420 of the movable member 400 on its rear side. The optical sensor 500 projects upward.

The optical sensor 500 includes a sensor frame 510 (FIG. 6). The sensor frame 510 has a substantially square-U shape and supports a light emitting portion and a light receiving portion facing each other. The optical sensor 500 is turned off when a detected portion 430 enters the square-U shaped sensor frame 510 to cut off light from the light emitting portion (refer to FIG. 7A). The optical sensor 500 is turned on when the detected portion 430 goes out from the square-U shaped sensor frame 510 and the light from the light emitting portion arrives at the light receiving portion (refer to FIG. 7B).

This structure allows the optical sensor 500 to detect the movement of the movable member 400, thereby a controller, not shown, determines whether a sheet P is set on the loading surface 221 based on information from the optical sensor 500. Thus, the controller allows the supply roller 110 to drive when the sheet P is set on the loading surface 221 and prevents the supply roller 110 from driving when the sheet P is not set on the loading surface 221.

The following will describe the operations of the movable member 400 and the overload prevention member 300 when a sheet P is set on the loading surface 221.

As shown in FIG. 7A, when a sheet stack having a maximum number of sheets P or more is inserted into between the overload prevention member 300 and the loading surface 221, a sheet stack P1 having a maximum number of sheets P, which corresponds to a number of sheets to be fit into a clearance provided between the overload prevention member 300 and the loading surface 221, is pressed rearward, and an excess sheet stack P2 having excess sheets P placed on top of the sheet stack P1 having maximum number of sheets P is blocked and stopped by the block surface 302 of the overload prevention member 300 such that the excess sheet stack P2 stays there. At this time, when a user recognizes that the excess sheet stack P2 is stopped by the overload prevention member 300, the user removes the excess sheet stack P2 and pushes only the sheet stack P1 further rearward, such that the sheet stack P1 is set on the loading surface 221.

Even when the user does not recognize that the excess sheet stack P2 is stopped by the overload prevention member 300, the user pushes the sheet stack P1 having the maximum number of sheets P further rearward, such that the movable member 400 is pushed rearward by the leading end of the sheet stack P1 as shown in FIG. 7B. Along with the movement of the movable member 400, the overload prevention member 300 rotates frontward and presses the excess sheet stack P2 back down frontward, so that the user can recognize the existence of the excess sheet stack P2.

Figure 7C:
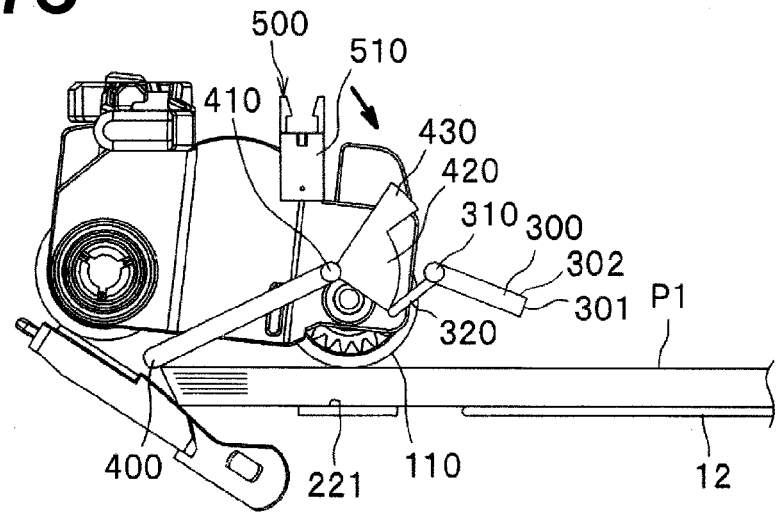
FIG. 7C illustrates that the overload prevention member is located in a third position.

When the overload prevention member 300 rotates frontward, the restriction surface 301 is withdrawn or separated upward from the sheet stack P1. As shown in FIG. 7C, when a sheet P is fed from the sheet stack P1 by the supply roller 110, the restriction surface 301 does not contact the sheet stack P1. Thus, the sheet stack P1 is free from a resistance from the restriction surface 301, and each sheet is fed from the sheet stack P1 by the supply roller 110.

According to the embodiment described above, the following advantages can be obtained.

Only by inserting the sheet stack P1 below the overload prevention member 300, the movable member 400 is moved and the restriction surface 301 of the overload prevention member 300 is withdrawn to the second position. Thus, there is no need to provide a dedicated drive source, contributing to cost reduction.

As the restriction surface 301 (the lower end) of the overload prevention member 300 moves upstream in the sheet feed direction, when sheets P exceeding the maximum loadable quantity are inserted, the overload prevention member 300 can press the excess sheet stack P2 back to the upstream side in the sheet feed direction. Thus, this can inform the user that the number of sheets P inserted exceeds the maximum loadable number of sheets.

The movement of the movable member 400 is detected by the optical sensor, thereby the movable member 400 can be used as a sensor for detecting the presence or absence of a sheet P. Thus, the number of parts can be reduced with manufacturing cost savings.

The overload prevention member 300 is disposed in the center relative to the width of a sheet P. In a structure where sheets P of any size are centered and fed, for example, the overload prevention member 300 disposed in the center relative to the width of the sheets P can reduce the overload of the sheets P even if the sheets P are small-sized. In addition, the overload prevention member 300 and the movable member 400 are disposed in the center relative to the sheet width. Compared with a case where the overload prevention member and the movable member are formed extending across the entire sheet width, the overload prevention member 300 and the movable member 400 can rotate with a smaller force. Thus, the overload prevention member 300 and the movable member 400 can rotate smoothly even when contacting a soft sheet P.

The above illustrative embodiment shows, but is not limited to, that the overload prevention member 300 is pivotable so that the restriction surface 301 is moved in an arc. The overload prevention member may be vertically movable relative to the casing such that the restriction surface is moved in a straight line.

The above illustrative embodiment shows, but is not limited to, the movable member 400 that rotates. The movable member may be slidable relative to the casing or movable on a straight line slanted from the horizontal.

The above illustrative embodiment shows, but is not limited to, that the rotatable movable member 400 and the rotatable overload prevention member 300 interlock each other by engaging the movable member 400 with the overload prevention member 300. The movable member and the overload prevention member may interlock each other via a gear, a link mechanism, or a cam mechanism disposed therebetween.

The above illustrative embodiment shows, but is not limited to, that the optical sensor 500 is configured to detect the swinging of the movable member 400. The detector may be configured to detect the swinging or movement of the overload prevention member. Even in this case, the overload prevention member moves along with the movement of the movable member, and thus the controller can determine whether a sheet is set on the loading surface.

The above illustrative embodiment shows, but is not limited to, the optical sensor 500 as a detector. The detector may include a rotational angle sensor and a pressure sensor and other sensors.

The above illustrative embodiment shows, but is not limited to, that the disclosure is applied to the manual feed mechanism 100. The disclosure may be applied to other sheet feeders, e.g., a sheet supply device that conveys sheets stored in a sheet supply tray, and a sheet feeder in a document reader.

The above illustrative embodiment shows, but is not limited to, the color printer 1 as an example of an image forming apparatus. The disclosure may be applied to other types of image forming apparatuses, e.g., a monochrome printer, a copier, and a multifunction apparatus.

The above illustrative embodiment shows, but is not limited to the support mechanism 140 by assembling the support member 170 that pivots vertically and the swing arm 180 that swings back and forth. A mechanism to rotatably support the supply roller at an end of an arm that swing vertically may be used as the support mechanism. In addition, the support mechanism may include a pinion and rack mechanism and a plurality of gears that vertically move a bracket that rotatably supports the supply roller.

The above illustrative embodiment show, but is not limited to the drive mechanism 150 using the cams and the latch mechanism. A cylinder that moves in the front-back direction relative to the left end portion of the swing arm 180 may be used as the drive mechanism. In this case, when the cylinder is withdrawn rearward, the left end portion of the swing arm 180 may be allowed to move rearward, and when the cylinder moves frontward, the left end portion of the swing arm 180 may be held at its original position.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. A sheet feeder comprising:

a casing having a loading surface on which a plurality of recording sheets are to be loaded;

a supply roller configured to feed the recording sheets loaded on the loading surface;

an overload prevention member disposed upstream from the supply roller in a sheet feed direction, the overload prevention member including a restriction surface configured to be moved between a first position where the restriction surface is separated a predetermined distance away from the loading surface and a second position where the restriction surface is separated further away from the loading surface than when the restriction surface is in the first position; and a movable member disposed downstream from the overload prevention member in the sheet feed direction, the movable member being configured to be moved from a third position to a fourth position by being pushed by leading ends of the recording sheets when the recording sheets are inserted downstream further than the overload prevention member in the sheet feed direction, wherein the movable member and the overload prevention member are configured to interlock each other such that, when the movable member is located in the third position, the restriction surface is located in the first position, and when the movable member is located in the fourth position, the restriction surface is located in the second position.

2. The sheet feeder according to claim 1, wherein the overload prevention member and the movable member are rotatably disposed in the casing, and wherein the restriction surface is configured to be moved from the first position to the second position located upstream from the first position in the sheet feed direction.

3. The sheet feeder according to claim 1, further comprising a detector disposed to the movable member and configured to detect a movement of the movable member.

4. The sheet feeder according to claim 1, wherein the overload prevention member is disposed in a position corresponding to a center of a width of a recording sheet to be loaded on the loading surface.

5. The sheet feeder according to claim 1, wherein the movable member is configured to be moved from the third position to the fourth position located downstream from the third position in the sheet feed direction.

6. An image forming apparatus comprising:

an image forming unit configured to form an image on a recording sheet; and a sheet feeder configured to feed the recording sheet to the image forming unit, the sheet feeder comprising:

a casing having a loading surface on which a plurality of recording sheets are to be loaded;

a supply roller configured to feed the recording sheets loaded on the loading surface;

an overload prevention member disposed upstream from the supply roller in a sheet feed direction, the overload prevention member including a restriction surface configured to be moved between a first position where the restriction surface is separated a predetermined distance away from the loading surface and a second position where the restriction surface is separated further away from the loading surface than when the restriction surface is in the first position; and a movable member disposed downstream from the overload prevention member in the sheet feed direction, the movable member being configured to be moved from a third position to a fourth position by being pushed by leading ends of the recording sheets when the recording sheets are inserted downstream further than the overload prevention member in the sheet feed direction, wherein the movable member and the overload prevention member are configured to interlock each other such that, when the movable member is located in the third position, the restriction surface is located in the first position, and when the movable member is located in the fourth position, the restriction surface is located in the second position.

7. A sheet feeder comprising:

a casing having a loading surface on which a plurality of recording sheets are to be loaded;

a supply roller configured to feed the recording sheets loaded on the loading surface;

a blocking member disposed upstream from the supply roller in a sheet feed direction, the blocking member including a block surface configured to be moved between a first position where the block surface is separated a first distance away from the loading surface and a second position where the block surface is separated a second distance away from the loading surface, the first distance being smaller than the second distance, the block surface being configured to block insertion of a recording sheet located at a distance greater than the first distance from the loading surface to a downstream side in the sheet feed direction when the block surface is in the first position, the block surface being configured to allow insertion of the recording sheets located within the first distance from the loading surface to the downstream side in the sheet feed direction when the block surface is in the first position;

a movable member disposed downstream from the blocking member in the sheet feed direction, the movable member being configured to be moved from a third position to a fourth position in response to the insertion of the recording sheets located within the first distance from the loading surface toward the downstream side in the sheet feed direction; and an interlocking mechanism configured to interlock the blocking member and the movable member such that, when the movable member is moved from the third position to the fourth position by insertion of the recording sheets, the block surface of the blocking member is moved from the first position to the second position.

8. The sheet feeder according to claim 7, wherein the blocking member and the movable member are rotatably disposed in the casing, and wherein the block surface is configured to be moved from the first position to the second position located upstream from the first position in the sheet feed direction.

9. The sheet feeder according to claim 7, wherein the blocking member is disposed in a position corresponding to a center of a width of a recording sheet to be loaded on the loading surface.

10. The sheet feeder according to claim 7, further comprising a detector configured to detect a movement of the movable member.

11. The sheet feeder according to claim 10, wherein the movable member includes an actuator configured to contact and press the blocking member such that the block surface is moved from the first position to the second position when the actuator is moved from the third position to the fourth position by the insertion of the recording sheets.

12. The sheet feeder according to claim 11, wherein, when the block surface is in the first position, the block surface is normal to the sheet feed direction and configured to contact the recording sheet located at the distance greater than the first distance from the loading surface and block the insertion of the recording sheet located at the distance greater than the first distance from the loading surface to the downstream side in the sheet feed direction, and wherein the detector is configured to detect the actuator.

13. The sheet feeder according to claim 7, wherein the blocking member further includes a restriction surface configured to define the first distance from the loading surface and restrict a maximum number of recording sheets to be inserted from the loading surface to the restriction surface when the block surface is in the first position.

14. The sheet feeder according to claim 13, wherein, when the block surface is in the first position, the restriction surface is disposed at a lower end surface of the blocking member.

15. The sheet feeder according to claim 13, wherein the supply roller is configured to move vertically such that, a lower end portion of the supply roller is disposed above the restriction surface when the block surface is in the first position and disposed below the restriction surface when the block surface is in the second position.

* * * * *